US009168979B1

(12) United States Patent
Schueller et al.

(10) Patent No.: US 9,168,979 B1
(45) Date of Patent: Oct. 27, 2015

(54) SYSTEMS AND METHODS FOR CORROSION PROTECTION ON MARINE DRIVES

(71) Applicant: Brunswick Corporation, Lake Forest, IL (US)

(72) Inventors: Niel M. Schueller, Fond du Lac, WI (US); Kevin R. Anderson, Fond du Lac, WI (US); David J. Waldvogel, Fond du Lac, WI (US); Carl J. Prien, Appleton, WI (US); John A. Groeschel, Theresa, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 14/183,976

(22) Filed: Feb. 19, 2014

Related U.S. Application Data

(60) Provisional application No. 61/781,864, filed on Mar. 14, 2013.

(51) Int. Cl.
*B63B 17/00* (2006.01)
*B63B 59/04* (2006.01)
*C23F 13/00* (2006.01)

(52) U.S. Cl.
CPC ..... *B63B 17/00* (2013.01); *B63B 59/04* (2013.01); *C23F 13/00* (2013.01)

(58) Field of Classification Search
CPC ..... B63B 59/00; B63B 59/04; B63B 59/08; C23F 13/00
USPC ..... 114/222; 204/196.05, 196.06, 196.18, 204/196.19, 196.37
See application file for complete search history.

(56) References Cited

U.S. PATENT DOCUMENTS

| | | | |
|---|---|---|---|
| 3,953,742 | A | 4/1976 | Anderson et al. |
| 4,322,633 | A | 3/1982 | Staerzl |
| 4,492,877 | A | 1/1985 | Staerzl |
| 4,528,460 | A | 7/1985 | Staerzl |
| 4,869,016 | A | 9/1989 | Diprose et al. |
| 6,173,669 | B1 | 1/2001 | Staerzl |
| 6,183,625 | B1 | 2/2001 | Staerzl |
| 6,209,472 | B1 | 4/2001 | Staerzl |
| 6,547,952 | B1 | 4/2003 | Staerzl |
| 6,822,462 | B1 | 11/2004 | Staerzl |
| 6,973,890 | B1 | 12/2005 | Staerzl |
| 7,025,013 | B1 | 4/2006 | Staerzl et al. |
| 7,064,459 | B1 | 6/2006 | Staerzl |
| 7,131,877 | B1 | 11/2006 | Staerzl |
| 7,211,173 | B1 | 5/2007 | Staerzl et al. |
| 7,305,928 | B2 | 12/2007 | Bradley et al. |
| 7,381,312 | B1 | 6/2008 | Misorski et al. |
| 7,686,936 | B1 | 3/2010 | Staerzl et al. |
| 8,118,983 | B1 | 2/2012 | Anderson et al. |
| 8,372,260 | B1 | 2/2013 | Staerzl et al. |
| 2010/0083893 | A1 | 4/2010 | Staerzl |

*Primary Examiner* — Lars A Olson
(74) *Attorney, Agent, or Firm* — Andrus Intellectual Property Law, LLP

(57) ABSTRACT

Methods and systems are for corrosion protection on marine vessels. A marine drive is for propelling a marine vessel in saltwater. The marine drive includes a generally planar outer running surface and a collection area located proximate to the outer running surface. An electrode conducts electricity from a source of electricity to the saltwater such that the electricity reacts to the saltwater and generates chlorine gas bubbles that tend to cause corrosion on the outer running surface. The electrode is mounted on the marine drive and protrudes out from and at an angle to the outer running surface so as to inhibit flow of the chlorine gas bubbles towards the collection area at least when the marine vessel is stationary.

16 Claims, 4 Drawing Sheets

SYSTEMS AND METHODS FOR CORROSION PROTECTION ON MARINE DRIVES

CROSS-REFERENCE

This application claims the benefit of and priority to U.S. Provisional Patent Application Ser. No. 61/781,864, filed Mar. 14, 2013, which is incorporated herein by reference in entirety.

FIELD

The present disclosure relates to systems and methods for corrosion protection on marine drives.

BACKGROUND

It is known that providing an electric current proximate an underwater surface in a saltwater environment inhibits and deters the growth of marine organisms, such as barnacles. It is believed that certain marine organisms, such as barnacles, abhor chlorine. When electric current is provided in a saltwater environment, the current interacts with the surrounding saltwater and produces chlorine gas, among other things, in the form of chemically adsorbed species and bubbles at the underwater surface. The production of chlorine increases with the current flow.

The following U.S. Patents, each of which are incorporated herein by reference in entirety, disclose propulsion arrangements for marine vessels and anti-fouling systems and methods for marine structures, including for example cathodic protection systems.

U.S. Pat. No. 3,953,742 discloses a cathodic protection system monitor that is coupled to an impressed current cathodic protection circuit and used for corrosion protection of a submerged marine drive. The cathodic protection circuit includes one or more anodes and a reference electrode mounted below the water line and connected to an automatic controller for supplying an anode current which is regulated in order to maintain a predetermined reference potential on the protected structure. A switch selectively connects a light emitting diode (LED) lamp or other light source between the controller output and ground so that the controller current may, when tested, be used to operate the light source in order to confirm that power is available to the anode.

U.S. Pat. No. 4,492,877 discloses an electrode apparatus for mounting an anode and reference electrode of a cathodic protection system on an outboard drive unit. The apparatus includes an insulating housing on which the anode and reference electrode are mounted and a copper shield mounted between the anode and electrode to allow them to be mounted in close proximity to each other. The shield is electrically connected to the device to be protected and serves to match the electrical field potential at the reference electrode to that of a point on the outboard drive unit remote from the housing.

U.S. Pat. No. 4,528,460 discloses a control system for cathodically protecting an outboard drive unit from corrosion, which includes an anode and a reference electrode mounted on the drive unit. Current supplied to the anode is controlled by a transistor, which in turn is controlled by an amplifier. The amplifier is biased to maintain a relatively constant potential on the drive unit when operated in either fresh or salt water.

U.S. Pat. No. 6,183,625 discloses a galvanic monitor system that uses two annunciators, such as light emitting diodes, to alert a boat operator of the current status of the boat's galvanic protection system. A reference electrode is used to monitor the voltage potential at a location in the water and near the component to be protected. The voltage potential of the electrode is compared to upper and lower limits to determine if the actual sensed voltage potential is above the lower limit and below the upper limit. The two annunciators lights are used to inform the operator if the protection is proper or if the component to be protected is either being over protected or under protected.

U.S. Pat. No. 6,209,472 discloses a system for inhibiting marine organism growth on underwater surfaces. The system provides an electric current generator which causes an electric current to flow proximate the underwater surface. A source of power, such as a battery, provides electrical power to the electric current generator. The flow of current passes from the underwater surface through water surrounding the surface or in contact with the surface, and a point of ground potential. The point of ground potential can be a marine propulsion system attached to a boat on which the underwater surface is contained.

U.S. Pat. No. 7,131,877 discloses a marine cathodic protection system that maintains a submerged portion of a marine drive unit at a selected potential to reduce or eliminate corrosion thereto. An anode is energized to maintain the drive unit at a preselected constant potential in response to the sensed potential at a closely located reference electrode during normal operations. Excessive current to the anode is sensed to provide a maximum current limitation. An integrated circuit employs a highly regulated voltage source to establish precise control of the anode energization.

U.S. Pat. No. 7,305,928 discloses a vessel positioning system that maneuvers a marine vessel in such a way that the vessel maintains its global position and heading in accordance with a desired position and heading selected by the operator of the marine vessel. When used in conjunction with a joystick, the operator of the marine vessel can place the system in a station keeping enabled mode and the system then maintains the desired position obtained upon the initial change in the joystick from an active mode to an inactive mode. In this way, the operator can selectively maneuver the marine vessel manually and, when the joystick is released, the vessel will maintain the position in which it was at the instant the operator stopped maneuvering it with the joystick.

U.S. Pat. No. 7,381,312 discloses a ceramic conductor, which is supported by an electrically insulative support member for attachment directly to a marine propulsion drive and for use as either an anode or electrode in a corrosion prevention system. The ceramic conductor is received within a depression formed in a surface of the electrically insulative support member and the exposed surface of the ceramic conductor can be offset from or coplanar with an exposed surface of the electrically insulative support member. The ceramic conductor can comprise oxides of iridium, tantalum and titanium that are formed as a coating on a titanium substrate.

U.S. Pat. No. 8,118,983 discloses a corrosion inhibiting system, which is provided with the ability to allow both primary and secondary portions of the circuit to be used in the alternative without having the primary and secondary systems interfere with each other by operating at the same time. By incorporating a continuity controller, such as a switch or a diode to selectively disconnect the sacrificial anode from the circuit, the primary and secondary systems can both be provided on a marine vessel, but used independently from each other. In that way, the primary and secondary corrosion inhibiting systems are prevented from interfering with each other during normal operation.

U.S. Pat. Nos. 4,322,633; 6,173,669; 6,547,952; 6,822,462; 6,973,890; 7,025,013; 7,064,459; 7,211,173; 7,686,936; 8,372,260 are also relevant background and are incorporated herein by reference.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

In certain examples, a corrosion protection system is provided on a marine drive for propelling a marine vessel in saltwater. The marine drive includes a generally planar outer running surface and a collection area located proximate to the outer running surface. An electrode conducts electricity from a source of electricity to the saltwater such that the electricity inhibits corrosion on the outer running surface with a byproduct of chlorine gas bubbles. The electrode is mounted on the marine drive and protrudes out from and at an angle to the outer running surface so as to inhibit flow of the chlorine gas bubbles towards the collection area at least when the marine vessel is stationary. In certain examples, the electrode includes an outer surface that is set at the angle to the outer running surface. The outer electrode surface faces away from the collection area. The collection area is positioned with respect to the electrode so that the collection area would collect the chlorine gas bubbles if the outer electrode surface were positioned flush with the outer running surface.

In certain examples, a retainer attaches the electrode to the marine drive. The retainer can include an inner retainer surface that mates with the marine drive and an outer retainer surface that faces away from the marine drive. The electrode can be attached to the outer retainer surface.

In certain other examples, methods are for preventing corrosion on the marine drive, the marine drive comprising the generally planar outer running surface and the collection area located proximate to the outer running surface. The method comprises emitting electricity to the saltwater via the electrode such that the electricity reacts with the saltwater and generates chlorine gas bubbles that tend to cause corrosion on the outer running surface, and inhibiting flow of the chlorine gas bubbles towards the collection area by orienting the electrode on the marine drive so that the electrode protrudes out from the outer running surface and faces away from the collection area. In certain examples, the method can include selecting an angle at which the electrode is mounted with respect to the outer running surface so that the chlorine gas bubbles are directed away from the collection area when the marine vessel is stationary.

In certain other examples, the noted system can be incorporated in a marine vessel having a hull with a tunnel, wherein the marine drive is mounted in the tunnel.

Various other aspects and exemplary combinations for these examples are further described herein below.

BRIEF DESCRIPTION OF THE DRAWINGS

Examples of systems and methods for corrosion protection on marine drives are described with reference to the following figures. The same numbers are used throughout the figures to reference like features and components.

DETAILED DESCRIPTION OF THE DRAWINGS

In the present description, certain terms have been used for brevity, clearness and understanding. No unnecessary limitations are to be inferred therefrom beyond the requirement of the prior art because such terms are used for descriptive purposes only and are intended to be broadly construed. The different systems and methods described herein may be used alone or in combination with other methods and systems. Various equivalents, alternatives, and modifications are possible within the scope of the appended claims.

Figure 1:
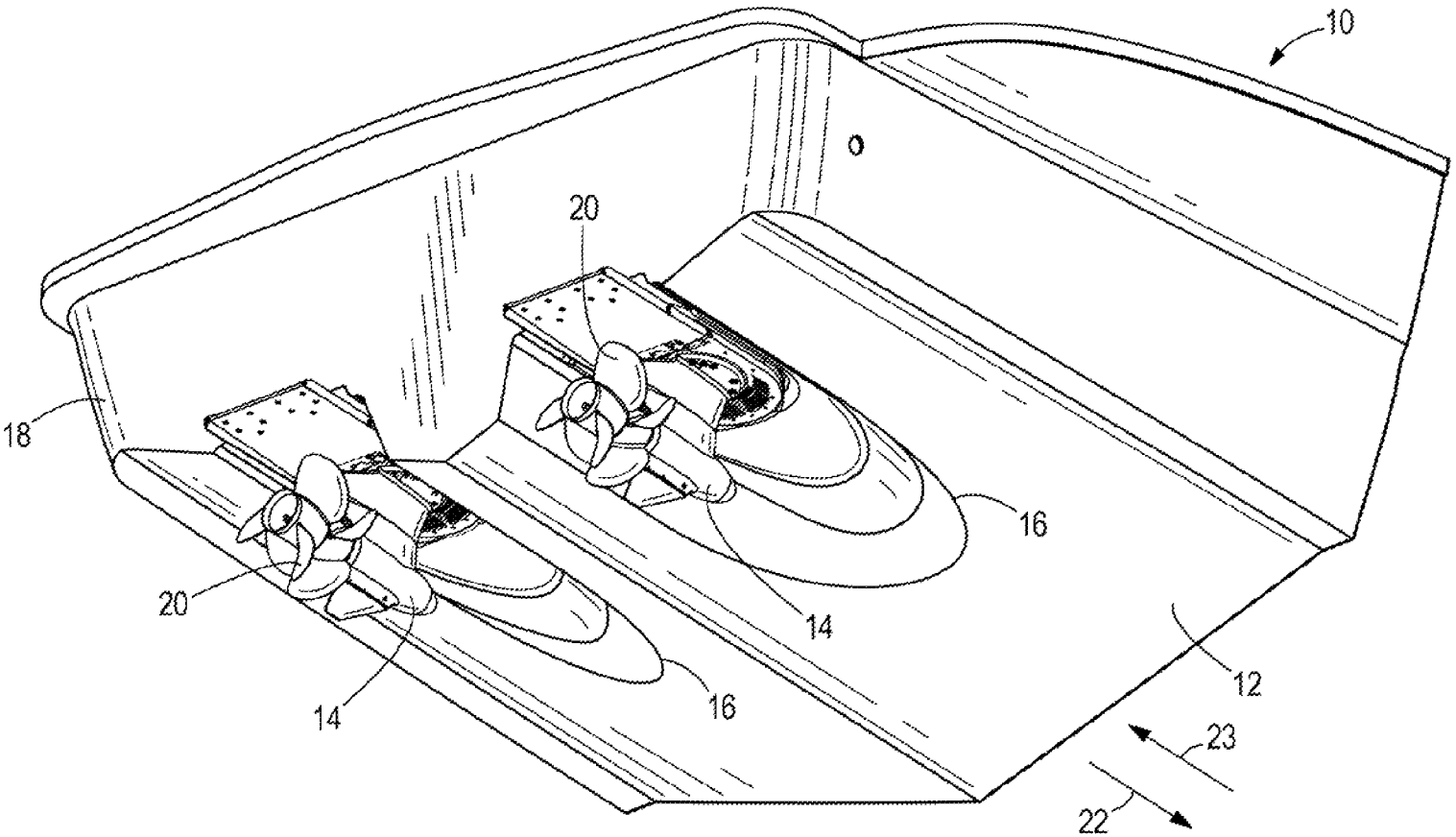
FIG. 1 is a perspective view of a marine vessel and a marine drive for propelling the marine vessel in saltwater.

FIG. 1 depicts a marine vessel 10 having a hull 12 on which a pair of marine drives 14 are mounted. The marine drives 14 are mounted in respective tunnels 16 that form depressions in the surface of the hull 12 at the stem 18 of the marine vessel 10. The marine drives 14 operate propellers 20 to propel the marine vessel 10 forwardly in the direction of arrow 22 and rearwardly in the direction of arrow 23 in a body of water in which the marine vessel 10 is operating, which can be for example saltwater.

Figure 2:
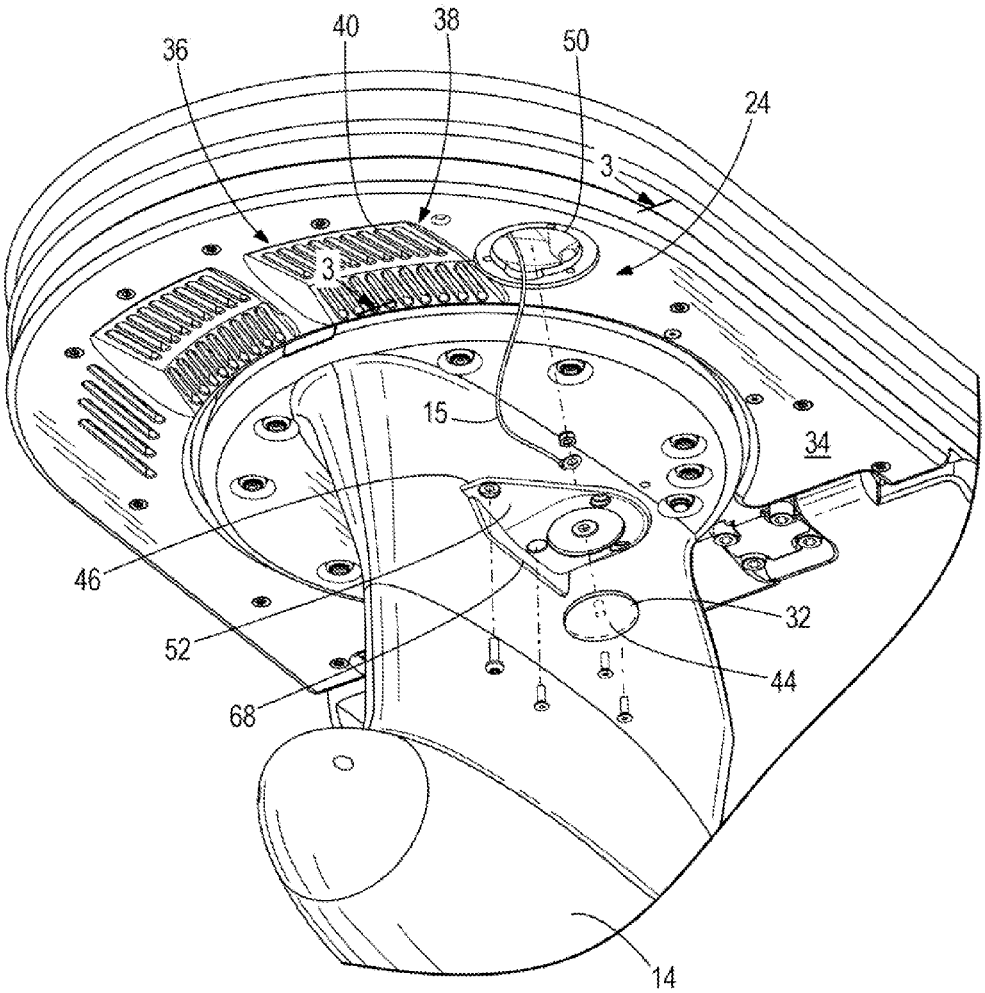
FIG. 2 is a perspective view of a corrosion protection system on the marine drive.
Figure 3:
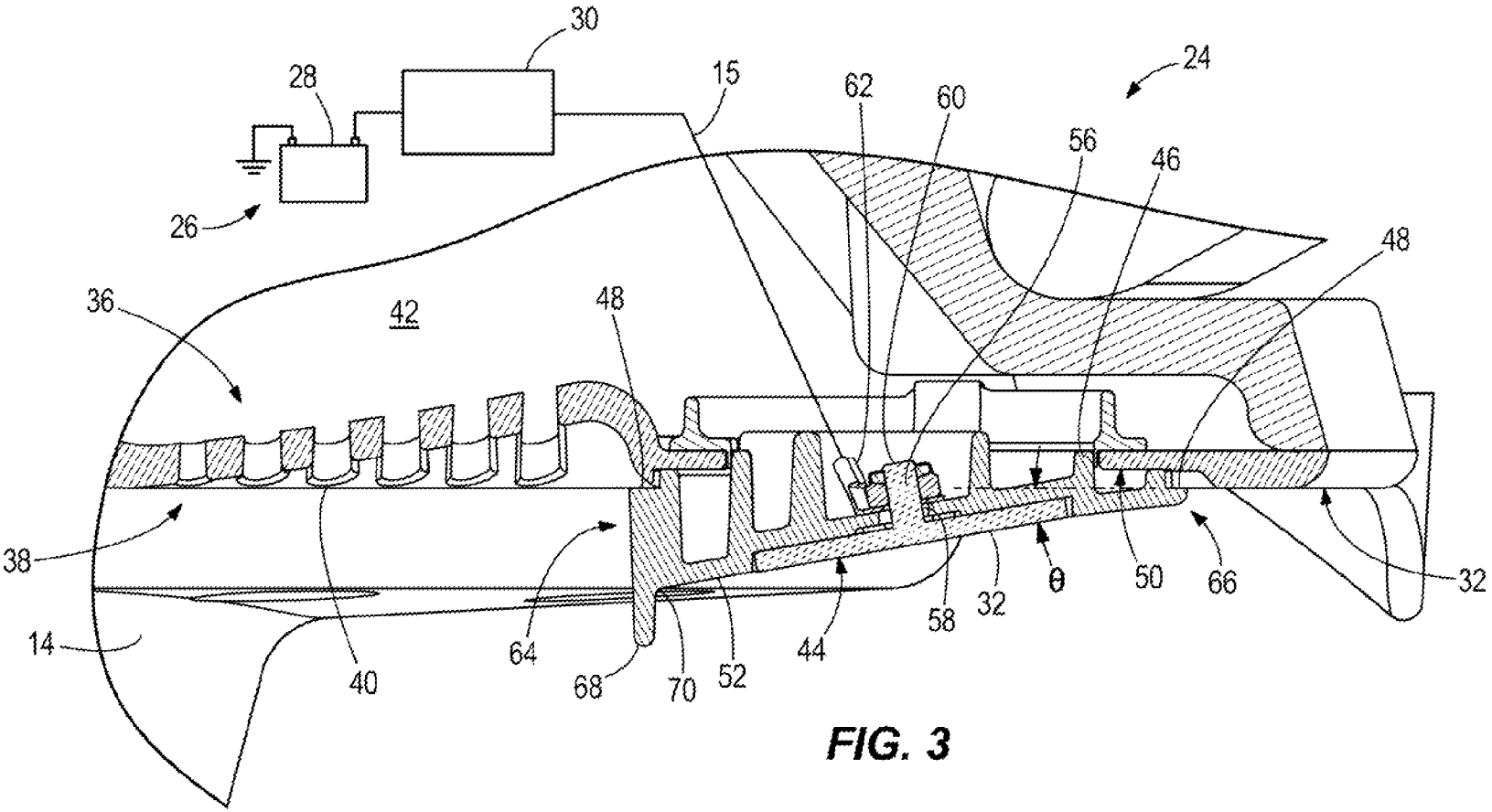
FIG. 3 is a section view of section 3-3, taken in FIG. 2.

FIGS. 2 and 3 depict a corrosion protection system 24 for inhibiting corrosion on the marine drive 14 and the hull 12 of the marine vessel 10, both in FIG. 1. The corrosion protection system 24 includes a source of electricity 26, which in this example includes a battery 28 and an electrical control circuit 30 for controlling flow of electricity via a conductive wire 15 to an electrode 32 mounted on the marine drive 14. In use, electricity from the battery 28 is provided to the electrode 32, which conducts the electricity to the surrounding saltwater. Essentially, the electrons from the battery 28 protect underwater metallic components of the marine vessel 10 and marine drive 14 from corrosion. An unintended consequence of this arrangement is that the electricity reacts with the saltwater and generates chlorine gas bubbles that can result in localized corrosion on the marine drive 14. The control circuit 30 includes a processor, a storage unit, software, a communication interface, and optionally a user interface. The processor loads and executes software from the storage system, including a software module. When executed by the control circuit 30, the software module directs the processor to control application of electricity from the battery 28 to the electrode 32, as is conventional. The configuration of the control circuit 30 can vary. Exemplary control circuits are disclosed in the incorporated U.S. patents cited in the Background section of this application.

FIGS. 1, 2 and 3 depict the marine drive 14, which has a generally planar outer running surface 34 and a collection area 36 located proximate to the outer running surface 34. In this example, the collection area 36 is a cooling water inlet 38 for receiving cooling water for cooling the marine drive 14. A grate 40 through which cooling water flows is located on the cooling water inlet 38. Cooling water flows through the grate 40 and into an inlet area 42 which is typically lined with bronze alloy surfaces. The type and physical configuration of the collection area 36 can vary from the examples shown and described herein. For example, the collection area 36 can include any type of depression or recess in the marine drive 14 that otherwise would collect chlorine gas bubbles generated by an electrode that is mounted flush with the outer running surface 34. The collection area 36 can generically be described as any area on the marine drive 14 and/or marine vessel 10 that can collect chlorine gas bubbles generated by the electrolysis activity of the corrosion protection system 24.

During research and development of corrosion protection systems, the present inventors have found that the noted electrode 32 can produce an abnormally high amount of chlorine gas bubbles, which migrate from the electrode 32 and into the collection area 36. The chlorine gas bubbles enter the collection area 36 through the grate 40 along with the flow of cooling water and land in the inlet area 42. This collection of chlorine gas bubbles in the inlet area 42 have been found by the present inventors to surprisingly cause corrosion in the form of a localized plug corrosion, i.e. dealuminumification of the noted bronze alloy surfaces of the inlet area 42. The aluminum contained in the alloy is leached from the bronze, which leaves characteristic purer copper coated pits. This highly localized pitting corrosion penetrates the casting of the marine drive 14, and once the casting is penetrated by the pit, external water pressure on the hull 12 may undesirably spray the engine compartment of the marine drive 14 with a fine mist of seawater. In an extreme case, the engine compartment may flood with water.

The present disclosure is designed to overcome the aforementioned problem. In particular, the electrode 32 is mounted on the marine drive 14 so as to protrude out from and at an angle θ to the outer running surface 34. The value of the angle θ can vary and can be selected based upon the respective locations of the collection area 36 and electrode 32 on the marine drive 14. In one example, the angle θ is approximately fifteen degrees. The term "approximately fifteen degrees" encompasses exactly fifteen degrees and angles that are thirteen to seventeen degrees. The electrode 32 has an outer electrode surface 44 that is set at the angle θ to the outer running surface 34. The outer electrode surface 44 faces away from the collection area 36 at the noted angle θ so as to inhibit flow of the chlorine gas bubbles towards the collection area 36, at least when the marine vessel 10 is stationary, which is the vast majority of the life of a typical marine vessel.

Figure 4:
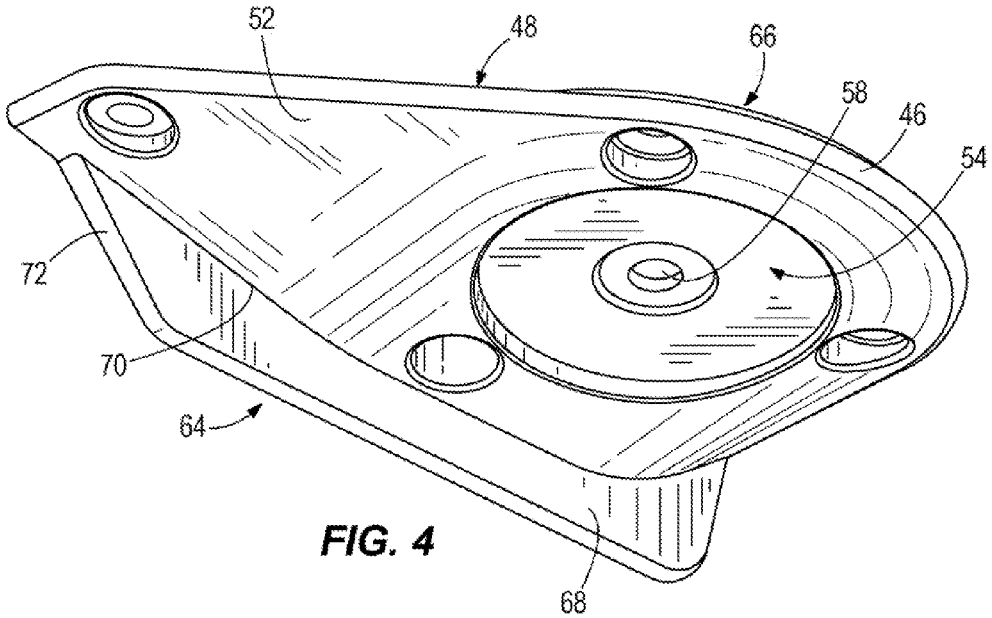
FIG. 4 is an isometric view of a retainer that attaches an electrode to the marine drive.

As depicted in FIGS. 2, 3 and 4, the means by which the electrode 32 is mounted to the marine drive 14 at the angle θ can vary. In this example, a retainer 46 attaches the electrode 32 to the marine drive 14. The retainer 46 has a retainer perimeter 48 that mates with a recess 50 in the outer running surface 34 of the marine drive 14. The retainer 46 also has an outer retainer surface 52 that faces away from the outer running surface 34 of the marine drive 14 when the retainer perimeter 48 is mounted in the recess 50. The electrode 32 is attached to the outer retainer surface 52, and more specifically in a recess 54 formed in the outer retainer surface 52. The electrode 32 has a stem 56 that protrudes through an inner throughhole 58 formed in the recess 54. The end 60 of the stem 56 is connected to an electrical contact 62, which is connected to the noted battery 28 via the conductive wire 15 and control circuit 30.

Figure 5:
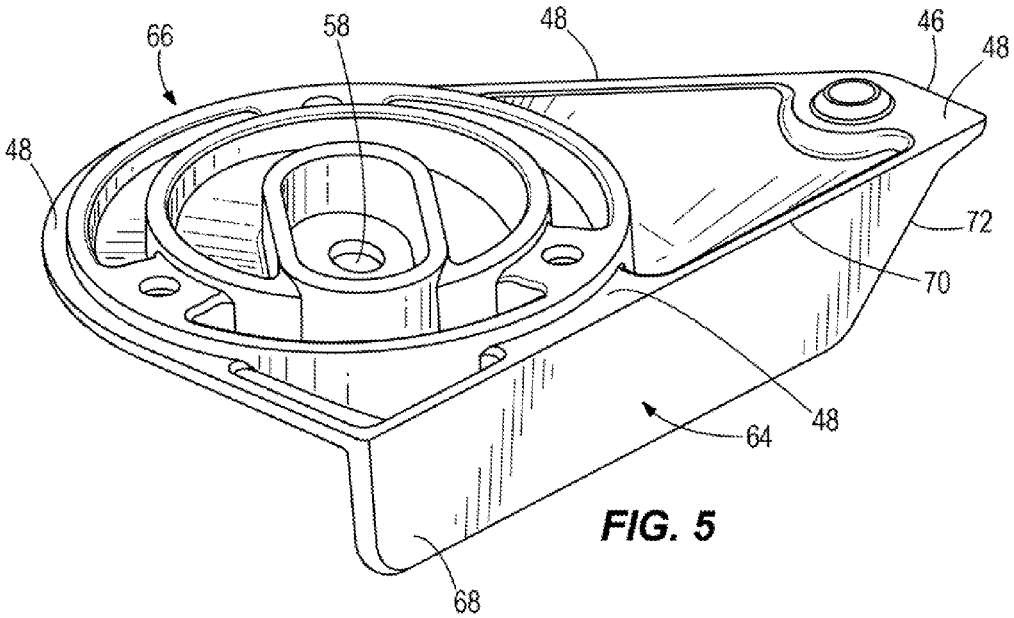
FIG. 5 is another isometric view of the retainer.

As depicted in FIGS. 3, 4 and 5, the outer retainer surface 52 is set at the angle θ to the inner retainer perimeter 48. The retainer 46 has a first end 64 that is located proximate to the collection area 36 and an opposite, second end 66 that is located distal from the collection area 36 relative to the first end 64. A baffle 68 is located at the first end 64. The baffle 68 extends along an edge 70 of the outer retainer surface 52 and has a tapered leading edge 72 that tapers relative to the outer electrode surface 44. The baffle 68 limits the flow of chlorine gas bubbles to the collection area 36 at least when the marine vessel 10 is stationary.

The present disclosure thus provides a method of preventing corrosion on the marine drive 14, which is for propelling the marine vessel 10 in saltwater. The marine drive 14 has the outer running surface 34 and the collection area 36 located proximate to the outer running surface 34. The method can include conducting electricity to the saltwater via the electrode 32 so that the electricity inhibits corrosion on the outer running surface 34. In order to prevent localized, unintended corrosion, the method can include inhibiting flow of the chlorine gas bubbles towards the collection area 36 by orienting the electrode 32 on the marine drive 14 so that the electrode 32 protrudes out from the outer running surface 34 and faces away from the collection area 36. The angle θ at which the electrode 32 is mounted with respect to the outer running surface 34 can be selected so that the chlorine gas bubbles are directed away from the collection area 36, at least when the marine vessel 10 is stationary. The baffle 68 can be provided between the electrode 32 and the collection area 36 and the height of the baffle 68 can be selected so as to inhibit a flow of chlorine gas bubbles to the collection area 36, at least when the marine vessel 10 is stationary.

In certain examples, the electrode 32 can have its outer electrode surface 44 set at the angle θ to the outer running surface 34 such that the outer electrode surface 44 faces away from the collection area 36. In certain examples, the retainer 46 can attach the electrode 32 to the marine drive 14. The retainer 46 can have a retainer perimeter 48 that mates with the marine drive 14 and an outer retainer surface 52 that faces away from the marine drive 14. The electrode 32 can be attached to the outer retainer surface 52, which can be set at the angle θ to the retainer perimeter 48. In certain examples, the outer retainer surface 52 has a first end 64 that is located proximate to the collection area 36 and an opposite, second end 66 that is located distal from the collection area 36. A baffle 68 can be located at the first end 64 and limit the flow of chlorine gas bubbles to the collection area 36 at least when the marine vessel 10 is stationary. At the first end 64, the retainer 46 has a first height relative to the outer running surface 34 and at the second end 66, the retainer 46 has a lesser, second height relative to the outer running surface 34. In certain examples, the second height can equal zero when the second end 66 is flush with the outer running surface 34. The baffle 68 can extend along an edge 70 of the outer retainer surface 52 and have a tapered leading edge 72 that tapers relative to the outer electrode surface 44.

Certain embodiments disclosed herein therefore overcome the aforementioned problems regarding collection of chlorine gas bubbles in the collection area 36. The geometry and configuration of certain examples disclosed herein cause the chlorine gas bubbles to drift away from the collection area 36 and outside of the tunnel, where the chlorine is diluted and will not contaminate the collection area 36. Certain examples are particularly useful in arrangements where the marine drive 14 is situated in a tunnel 16, wherein flow of water is particularly slow/stagnant when the marine vessel 10 is stationary.

What is claimed is:

1. A corrosion protection system, the system comprising:

a marine drive for propelling a marine vessel in saltwater, the marine drive comprising a generally planar outer running surface and a collection area located proximate to the outer running surface;

a source of electricity; and an electrode that conducts the electricity to the saltwater such that the electricity inhibits corrosion on the outer running surface with a byproduct of chlorine gas bubbles;

wherein the electrode is mounted on the marine drive and protrudes out from and at an angle to the outer running surface so as to inhibit flow of the chlorine gas bubbles towards the collection area at least when the marine vessel is stationary;

wherein the electrode comprises an outer electrode surface that is set at said angle to the outer running surface, and wherein the outer electrode surface faces away from the collection area; and wherein the collection area is positioned with respect to the electrode so that the collection area would collect the chlorine gas bubbles if the outer electrode surface were positioned flush with the outer running surface.

2. The system according to claim 1, wherein the angle is approximately fifteen degrees.

3. A corrosion protection system, the system comprising:

a marine drive for propelling a marine vessel in saltwater, the marine drive comprising a generally planar outer running surface and a collection area located proximate to the outer running surface;

a source of electricity; and an electrode that conducts the electricity to the saltwater such that the electricity inhibits corrosion on the outer running surface with a byproduct of chlorine gas bubbles;

wherein the electrode is mounted on the marine drive and protrudes out from and at an angle to the outer running surface so as to inhibit flow of the chlorine gas bubbles towards the collection area at least when the marine vessel is stationary; and a retainer that attaches the electrode to the marine drive, the retainer comprising a retainer perimeter that mates with the marine drive and an outer retainer surface that faces away from the marine drive, wherein the electrode is attached to the outer retainer surface.

4. The system according to claim 3, wherein the outer retainer surface is set at said angle to the inner retainer perimeter.

5. The system according to claim 4, wherein the outer retainer surface comprises a first end that is located proximate to the collection area and an opposite, second end that is located distal from the collection area; and comprising a baffle located at the first end and limiting the flow of chlorine gas bubbles to the collection area at least when the marine vessel is stationary.

6. The system according to claim 5, wherein at the first end, the retainer has a first height relative to the outer running surface; and wherein at the second end, the retainer has a lesser, second height relative to the outer running surface.

7. The system according to claim 5, wherein the baffle extends along an edge of the outer retainer surface and comprises a tapered leading edge that tapers relative to the outer electrode surface.

8. A corrosion protection system, the system comprising:

a marine drive for propelling a marine vessel in saltwater, the marine drive comprising a generally planar outer running surface and a collection area located proximate to the outer running surface;

a source of electricity; and an electrode that conducts the electricity to the saltwater such that the electricity inhibits corrosion on the outer running surface with a byproduct of chlorine gas bubbles;

wherein the electrode is mounted on the marine drive and protrudes out from and at an angle to the outer running surface so as to inhibit flow of the chlorine gas bubbles towards the collection area at least when the marine vessel is stationary; and wherein the collection area comprises a cooling water inlet for the marine drive.

9. The system according to claim 8, wherein the collection area comprises an interior surface made of bronze alloy.

10. The system according to claim 8, comprising a grate on the cooling water inlet.

11. A corrosion protection system, the system comprising:

a marine drive for propelling a marine vessel in saltwater, the marine drive comprising a generally planar outer running surface and a collection area located proximate to the outer running surface;

a source of electricity; and an electrode that conducts the electricity to the saltwater such that the electricity inhibits corrosion on the outer running surface with a byproduct of chlorine gas bubbles;

wherein the electrode is mounted on the marine drive and protrudes out from and at an angle to the outer running surface so as to inhibit flow of the chlorine gas bubbles towards the collection area at least when the marine vessel is stationary; and further comprising the marine vessel, wherein the marine drive is mounted in a tunnel on a hull of the marine vessel.

12. A corrosion protection system the system comprising:

a marine drive for propelling a marine vessel in saltwater, the marine drive comprising a generally planar outer running surface and a collection area located proximate to the outer running surface;

a source of electricity;

an electrode that conducts the electricity to the saltwater such that the electricity inhibits corrosion on the outer running surface with a byproduct of chlorine gas bubbles;

wherein the electrode is mounted on the marine drive and protrudes out from and at an angle to the outer running surface so as to inhibit flow of the chlorine gas bubbles towards the collection area at least when the marine vessel is stationary; and a baffle located between the electrode and the collection area, the baffle outwardly extending from the outer running surface so as to inhibit a flow of chlorine gas bubbles to the collection area at least when the marine vessel is stationary.

13. A method of preventing corrosion on a marine drive for propelling a marine vessel in saltwater, the marine drive comprising a generally planar outer running surface and a collection area located proximate to the outer running surface, the method comprising:

conducting electricity to the saltwater via an electrode such that the electricity reacts with the saltwater and generates chlorine gas bubbles that tend to cause corrosion on the outer running surfaces;

inhibiting flow of the chlorine gas bubbles towards the collection area by orienting the electrode on the marine drive so that the electrode protrudes out from the outer running surface and faces away from the collection area;

selecting an angle at which the electrode is mounted with respect to the outer running surface so that the chlorine gas bubbles are directed away from the collection area at least when the marine vessel is stationary; and providing a baffle between the electrode and the collection area and selecting a height of the baffle so as to inhibit a flow of chlorine gas bubbles to the collection area at least when the marine vessel is stationary.

14. A marine vessel comprising:

a hull having a tunnel;

a marine drive mounted in the tunnel, the marine drive comprising a generally planar outer running surface and a collection area located proximate to the outer running surface;

a source of electricity;

an electrode that conducts the electricity to the saltwater such that the electricity reacts with the saltwater and generates chlorine gas bubbles that tend to cause corrosion on the outer running surface;

wherein the electrode is mounted on the marine drive and protrudes out from and at an angle to the outer running surface so as to inhibit flow of the chlorine gas bubbles towards the collection area at least when the marine vessel is stationary.

15. The marine vessel according to claim 14, wherein the electrode comprises an outer electrode surface that is set at said angle to the outer running surface, and wherein the outer electrode surface faces away from the collection area; and wherein the collection area is positioned with respect to the electrode so that the collection area would collect the chlorine gas bubbles if the outer electrode surface were positioned flush with the outer running surface.

16. The marine vessel according to claim 15, comprising a retainer that attaches the electrode to the marine drive, the retainer comprising an inner retainer perimeter that mates with the marine drive and an outer retainer surface that faces away from the marine drive, wherein the electrode is attached to the outer retainer surface; wherein the outer retainer surface comprises a first end that is located proximate to the collection area and an opposite, second end that is located distal from the collection area; and comprising a baffle located at the first end and limiting the flow of chlorine gas bubbles to the collection area at least when the marine vessel is stationary.

* * * * *